US010245640B2

(12) United States Patent
Rosinski

(10) Patent No.: US 10,245,640 B2
(45) Date of Patent: Apr. 2, 2019

(54) DEVICE AND A METHOD FOR CONSOLIDATION OF POWDER MATERIALS

(71) Applicant: GENICORE SPOLKA Z OGRANICZONA ODPOWIEDZIALNOSCIA, Konstancin-Jeziorna (PL)

(72) Inventor: Marcin Rosinski, Warsaw (PL)

(73) Assignee: GENICORE SPOLKA Z OGRANICZONA ODPOWIEDZIALNOSCIA, Konstancin-Jeziorna (PL)

( * ) Notice: Subject to any disclaimer, the term of this patent is extended or adjusted under 35 U.S.C. 154(b) by 672 days.

(21) Appl. No.: 14/780,666

(22) PCT Filed: Mar. 28, 2014

(86) PCT No.: PCT/IB2014/060261

§ 371 (c)(1),
(2) Date: Sep. 28, 2015

(87) PCT Pub. No.: WO2014/155352

PCT Pub. Date: Oct. 2, 2014

(65) Prior Publication Data

US 2016/0059307 A1 Mar. 3, 2016

(30) Foreign Application Priority Data

Mar. 28, 2013 (PL) ..... 403344

(51) Int. Cl.

| | |
|---|---|
| ***B22F 3/105*** | (2006.01) |
| ***B22F 3/087*** | (2006.01) |
| ***B28B 11/24*** | (2006.01) |

(52) U.S. Cl.

CPC ..... *B22F 3/105* (2013.01); *B22F 3/087* (2013.01); *B28B 11/243* (2013.01); *B22F 2003/1051* (2013.01); *B22F 2202/06* (2013.01)

(58) Field of Classification Search

CPC ... B22F 2003/1051; B22F 3/105; B22F 3/087

(Continued)

(56) References Cited

U.S. PATENT DOCUMENTS

| | | | | |
|---|---|---|---|---|
| 3,508,029 | A | 4/1970 | Inoue | |
| 3,670,137 | A * | 6/1972 | Inoue | B22F 3/105 219/149 |

(Continued)

FOREIGN PATENT DOCUMENTS

| | | | |
|---|---|---|---|
| GB | 829170 | A | 2/1960 |
| GB | 1349860 | A | 4/1974 |

(Continued)

*Primary Examiner* — Weiping Zhu

(74) *Attorney, Agent, or Firm* — Browdy and Neimark, PLLC

(57) ABSTRACT

The object of the invention is a device intended for powder materials consolidation, provided with an operating chamber, press connected to high-current discharge electrodes top and bottom, with arranged therebetween the sintered powder subjected to the pressure exerted by the press. To the top and bottom electrode there is connected a capacitive circuit with a power supply unit, closed by a high-current switch being a transistor switch. The object of the invention is also a method of powder materials consolidation in the device according to the invention, wherein the powder material is subjected to simultaneous operation of pressure in the range of 1-200 MPa and consolidation by electric current pulses with intensity of 1-80 kA, repeated with frequency from the range of 0.1 Hz to 100 Hz, generated by opening and closing the transistor switch.

4 Claims, 6 Drawing Sheets

(58) Field of Classification Search
USPC ..... 419/52
See application file for complete search history.

(56) References Cited

U.S. PATENT DOCUMENTS

| | | | |
|---|---|---|---|
| 4,929,415 | A | 5/1990 | Okazaki |
| 5,084,088 | A | 1/1992 | Okazaki |

FOREIGN PATENT DOCUMENTS

| | | | |
|---|---|---|---|
| JP | 03201519 | A | 9/1991 |
| JP | 03201520 | A | 9/1991 |
| JP | 03267552 | A | 11/1991 |
| JP | 098364 | A | 1/1997 |
| JP | 10298608 | A | 11/1998 |
| WO | 0204153 | A1 | 1/2002 |
| WO | 2010070623 | A2 | 6/2010 |

* cited by examiner

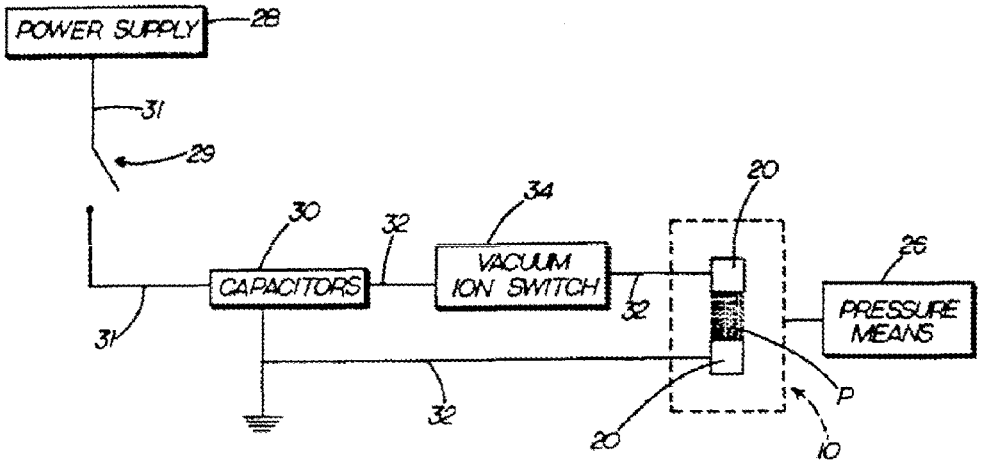
Fig. 1a (State of the art)
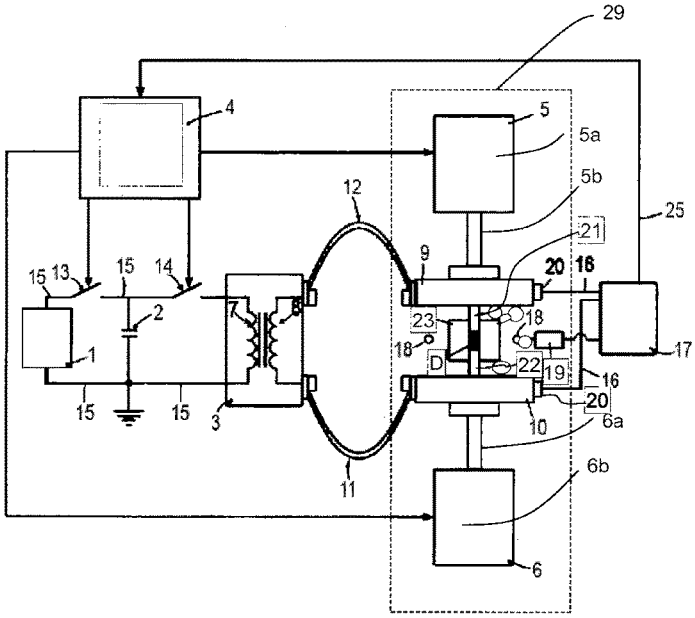
Fig.1b (State of the art)

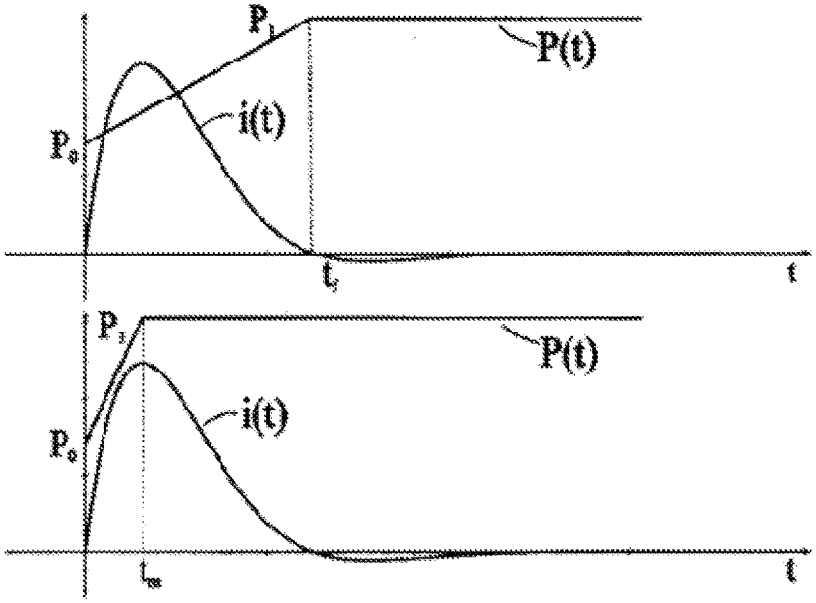
Fig. 2 (State of the art)
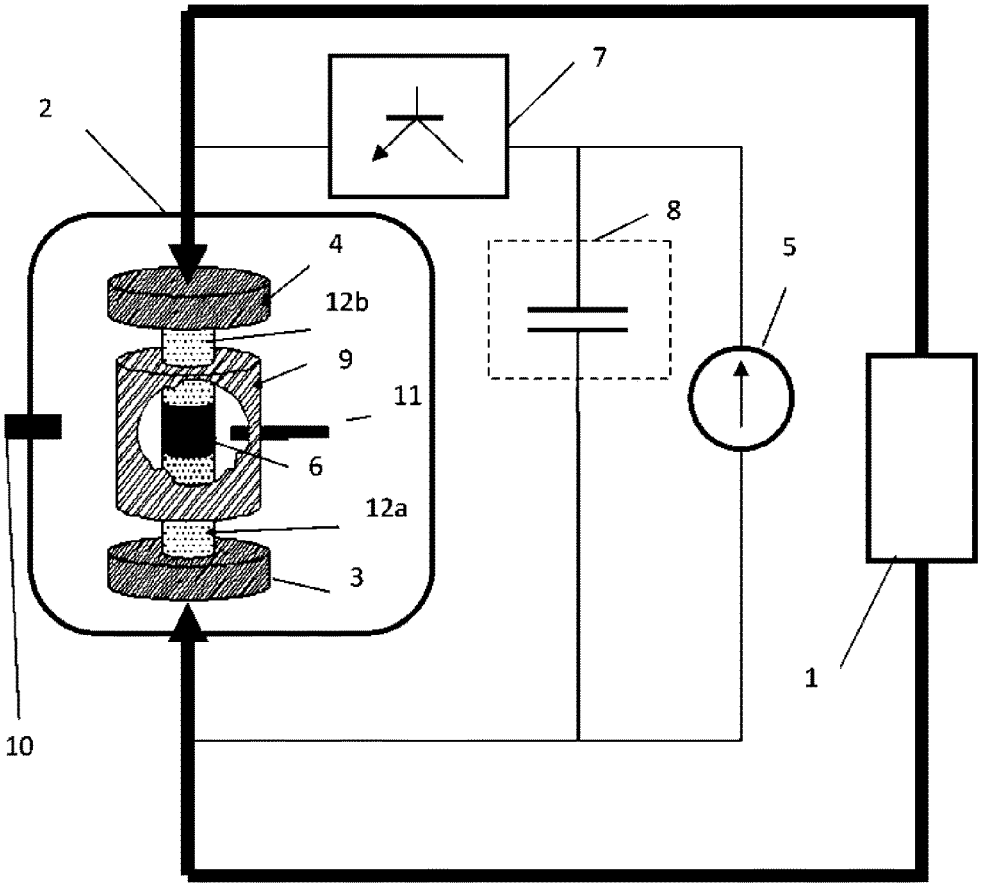
Fig.3

Parameters of the device according to the invention

| | |
|---|---|
| Maximal discharge voltage | 8 kV |
| Maximal current peak | 80 kA |
| Discharge time @ U = 8 kV | < 1ms |
| Discharge repetition frequency | 100 Hz |
| Operating pressure | $1 \cdot 10^{5} \div 1 \cdot 10^{-8}$ Pa |
| Maximal press pressure | 100 ton |
| Maximal sintering temperature | 2300 K |

Fig. 4

DEVICE AND A METHOD FOR CONSOLIDATION OF POWDER MATERIALS

FIELD

The present invention relates to a device for sintering of a broad group of nanocrystalline, sub-micron and micron powders, and in particular for production of composite materials with inclusions of particles such as: diamond, cubic boron nitride, $Al_2O_3$, SiC, $Si_3N_4$, WC, Ta, $ZrO_2$, TiC, TiN and the like, together or separately, in matrix of hard material, such as: sintered carbides or high thermal conductivity materials, such as tungsten, molybdenum, aluminium, copper, together or separately.

BACKGROUND

The process of sintering, manifested by transition of a porous set of powder particles into a solid material, is related to transport of mass in the porous set of particles. One of technologies of material production is powder metallurgy, in which, generally, powder compaction employs: free sintering, hot pressing or hot isostatic pressing.

Sintering by conventional methods often leads to grain growth, and as a consequence, to loss of properties resulting from the grain growth in the consolidated material. It happens particularly in the case of consolidation of materials with sub- and nanocrystalline grain size. Particularly significant grain growth during sintering nanocrystalline materials is observed after reaching critical density amounting 90% of the solid material's value. In result, it is difficult to obtain simultaneously a material with grain size below 100 nm and density close to theoretical by conventional sintering methods.

In the last 10-20 years a significant development of electric field activated sintering methods has occurred. These methods allow to conduct the sintering process in a very short time, from a few to over a dozen of minutes, limiting this way grain growth in the consolidated material. In the literature they are referred to as: Electro Discharge Compaction (EDC). Generally, these methods fall into methods with activation by electric field. In these techniques, similarly like in conventional hot pressing (HIP), the sintering process is realized with uni-axial pressure. A significant disadvantage of hot pressing is high temperature, long process time and small efficiency of heating of the consolidated powder. Moreover, high temperature and long consolidation process time are disadvantageous for obtaining materials with nanocrystalline microstructure. Electric field activated methods also vary in method of thermal energy transfer to the sintered material.

In conventional sintering, thermal energy is delivered through radiation and heat conduction, causing heating of the sintered material from the top of the sinter to its core. This heating method results in small speed and efficiency of heating.

In electric field activated sintering methods, like EDC, thermal energy is discharged directly in the whole volume of the sintered material. This heating method results in high energy efficiency of these methods, because of small losses of energy into the environment. Although heating of the die by current pulses is not different from direct current heating in conventional methods, heating of powder is much more complex. This is caused by many possible paths of current flow through the consolidated powder. In these methods there occur many phenomena activating the sintering process. Spark discharges remove the layer of oxides and adsorbed gasses from the surface of particles and form new contacts and necks by arc discharges. Locally, due to Joule heat generation, contacts and necks are formed, improving further compaction in the sintering process.

In EDC type the source of the energy is a capacitor or a capacitor battery rated for voltage of few thousand to tens of thousands volts. This solution has been disclosed e.g. in U.S. Pat. Nos. 4,929,415; 5,084,088; in which, as shown, a capacitor battery having capacitance of 240 μF has been used and the voltage of operation was between 3 and 30 kV. According to the disclosure and state of the art in the field of EDC type sintering methods, application of high voltage of the order of a few thousand volts is critical especially in the initial phase of the sintering process and is related to phenomena of spark discharges between grains of the powder being sintered. By charging and discharging of electric energy high-temperature spark or plasma discharges appear between powder particles. Pulse plasma activates the surface of the sintered particles, removes the oxide layer. In electric field activated sintering removal of oxides and later interparticle connection occur due to miscellaneous phenomena of resistive heating from thermal and electrical breakdown of the isolating film to arc discharges. The arising difference of potentials between two particles becomes high enough for spark generation and releasing ionization process. Plasma generated between particles serves for activation of their surface by oxide and other impurity removal.

Advantages of EDC method include:

- low temperature of sintering process,
- shorter sintering process time,
- speed of heating unattainable for other sintering techniques,
- high thermal efficiency, which is defined by heating method, electric current is directly applied to the sample and electrically conductive die,
- possibility of sintering powder materials impossible to produce by classic methods.

EDC process uses oscillatory discharging of the capacitor battery for generation of current surges with first half-wave amplitude on the order of tens of kA and total discharge time ca. 1 ms. Operation cycle includes charging the capacitor battery to a given voltage value (from a few to tens of kV), and then oscillatory pulse discharge in the load circuit. EDC process is used to consolidate powder materials (Orrú R, Licheri R, Locci A M, Cincotti A and Cao G 2009 Mater. Sci. Eng. R 63 127), where the energy source is a high value capacitor, with capacitance of hundreds of microfarads. EDC is based on high-voltage discharge (to 30 kV), high pulse current density delivered directly from the capacitor battery with external pressure to the material being sintered, due to which a rapid increase of temperature and very quick sintering process are obtained. In these methods the energy stored in the capacitor battery is delivered to the sintered powder placed in the die and subjected to a simultaneous process of pressing. The cycle of charging the capacitor battery and subsequent discharging repeats with frequency limited on one hand by the power of supply unit charging the battery, and on the other hand by parameters of the spark gap closing the discharging circuit of the capacitor or capacitor battery. So far, in processes using pulsed electric discharging the impulses are initiated by triggering system comprising a triggering module and an air gap switch closing the electric circuit. The triggering module causes electric arcing between the initiating electrode and the receiving electrode. The presence of arcing enables the proper discharge between the main electrodes, which, because of current intensity of tens of thousands amperes, leads to a quick wearing-out of operational surfaces of both electrodes. This process is particularly intensive on edges of the electrodes, because of very high current densities. This results in accelerated wearing-out of the electrodes, and thereby significant decrease of durability of discharging circuitry comprising spark gaps. Their maximum frequency of operation is also limited, caused by presence of ionized air after each discharge. A subsequent discharge can occur only after removal of the ionized air from the space between the electrodes, what, depending on the spark gap's construction and operating voltage, takes at least 0.3 s. This time significantly limits the frequency of operation of spark gaps.

U.S. Pat. No. 3,670,137 discloses a method of increasing the fatigue resistance of an iron containing metallic body. The method comprises the step of spark sintering a surface layer of tungsten carbide thereto by positioning a mass of tungsten-carbide powder along said body, positioning an electrode in continuous direct contact with said powder but with a spacing from said body and intermittently effecting an interrupted impulsive spark discharge between said electrode and said body and among the particles of said powder and between the body and the particles of said mass proximal to said body. Said discharge body is dimensioned to fuse said particles to one another and said body without melting of said mass. Voltages of 50 and 120 V has been applied.

The method is applied in a device that permits control of the density of the sintered body by varying the mechanical pressure applied thereto, and provides means to control the density of the sample by regulating the frequency of the discharge at least during the early stages. To this end the direct-current source of the device is connected in series with the output winding of a transformer. This transformer forms part of a varying-frequency oscillator and is saturable to control this oscillator. The oscillator consists of a pair of push-pull transistors whose emitters are energized by a battery in series with respective sections of the primary winding of the transformer. The base of each transistor is serially connected with the energizing windings of the transformer and returned to the emitter via a suitable biasing resistor. The transformer is also provided with a control winding in series with a rectifier and a variable resistor for determining the degree of saturation of the core and thus the frequency of oscillation. The control circuit is bridged across the electrode, and detects the direct-current-voltage drop thereacross. This circuit is poled so as to increase the frequency of the oscillation should the density of the sintered body fall below a predetermined value.

A problem restricting commercial use of EDC type sintering methods is the dependence of spark gap breakdown voltage on environmental conditions, especially air humidity. With the increase of humidity the breakdown voltage decreases, and this in consequence results in loss of technological process repeatability and reflects in the quality of the manufactured product. This problem can be solved by placing the installation in an air-conditioned room with automatic humidity level stabilization. This causes increased production cost and is troublesome in industrial conditions.

Spark gaps pose also a problem with reaching proper speed and precision of control of technological process parameters. This relates e.g. to the necessity of change from a large value current surge to low value with simultaneous increase of frequency of these surges. In circuits of oscillatory capacitor battery discharging such change is achieved by modification of its charging voltage. For a discharge to occur between spark gap's electrodes it is necessary to modify the distance between them, and this requires a break in the technological process.

Despite disclosing more than 20 years ago in document U.S. Pat. No. 5,084,088 a device shown in FIG. 1*a* and numerous advantages of the EDC method, so far consolidation methods using energy stored in a capacitor battery are not used on an industrial scale. The problem of low durability of devices has been partly solved by application of the device disclosed in international patent application WO 2010/070623. In this device there is used a capacitor battery charged by a power supply and discharged through the sample being heated. Quick wearing-out of the electrodes, usually made of tungsten, molybdenum or copper, makes it impossible to fully utilize the advantages of EDC methods. The solution proposed in document WO 2010/070623 was to use a voltage transformer—FIG. 1*b*, connected between the switch shorting the capacitor battery, and the sintered sample. The use of voltage transformer provides a longer operation without failure, but simultaneously increases current pulse duration and decreases its maximal value—a current pulse from the state of the art is shown in FIG. 2; tf value is ca. 30 ms—thus making it impossible to utilize the advantages of the EDC process.

SUMMARY

The object of the present invention is to provide a sintering device allowing a precise and quick control of temperature during sintering process, adapted to feed to the sample high and narrow current pulses, repeated with high frequency, with simultaneous provision of a long operation without failure, and a method of powder material sintering, and, in case of diamond based materials, without graphitizing them.

Reaching the object of the invention is provided by sintering device equipped with an operational chamber, a press connected to a top electrode and a bottom electrode, between which there is a die accommodating the consolidated powder, onto which the press exerts pressure. Wherein, to the top electrode and to the bottom electrode there is connected a capacitive circuit with a power supply, closed by a high-current switch for closing the capacitive circuit through the sample being sintered, wherein the high-current switch is a transistor switch (7).

Preferably, the transistor switch comprises eight transistors connected in parallel.

Preferably, the transistor switch (7) is adapted to form rectangular pulses, and most preferably, it is adapted to deliver energy to the set being sintered in the form of short pulses with the same and high amplitude, and delivering the same energy in cyclic oscillatory fading waveform of capacitor battery discharging depending on the control signal waveform.

Each transistor in the transistor switch is preferably connected to individual control circuit comprising an adjusted turn-on delay path and an adjusted turn-off delay path.

Preferably the sintering device is further provided with temperature measuring means.

Preferably the temperature measuring means comprise a thermocouple.

Preferably the temperature measuring means comprise a pyrometer.

Preferably the temperature measuring means comprise a thermal imaging camera.

Preferably the electrodes are galvanically isolated from the operational chamber.

Preferably the device is provided with means for cooling the electrodes with a cooling medium.

Preferably the device is provided with sintering process imaging means.

Preferably the capacitive circuit is a capacitor battery with equivalent capacitance in the range of 50-1000 μF and maximal operating voltage of 15 kV.

The object of the invention is also reached by providing a method of powder materials consolidation, wherein the consolidated powder is placed in a die between two electrodes connected to the press exerting pressure onto the powder being consolidated by means of punches. Wherein, a voltage is applied to the electrodes using a capacitive circuit with a power supply, closed by a transistor switch. The powder material is subjected to simultaneous operation of pressing pressure in the range of 1 to 200 MPa and process of sintering by high-current electric pulses with intensity in the range of 1 to 80 kA, repeated with frequency in the range of 0.1 Hz to 100 Hz, depending on the capacitor battery charging voltage, caused by opening the transistor switch. Preferably, electric current pulses are obtained by discharging the battery of capacitors in a capacitive circuit, charged to the voltage of 0.5-15 kV.

Preferably the transistor switch is fed with a control signal disconnecting the capacitor battery discharging circuit during the discharge, most preferably so that a rectangular pulse of capacitor battery discharging current is achieved.

Preferably the powder material is previously subjected to operation of pressing load in the range of 1-200 MPa, at atmospheric pressure or at lowered pressure ($1\cdot10^{-8}$ Pa), in a neutral gas or other working gas, before subjecting to operation of electric current pulses.

Preferably the consolidation is done in temperature from the range of 0.5 to 0.8 of melting temperature of consolidated material or melting temperature of consolidated material matrix.

Preferably as the powder material are used powder materials being metallic, ceramic, intermetallic, composites comprising a metallic matrix and dispersed non-metallic particles and mixtures of them.

Preferably as the powder material is used: diamond, cubic boron nitride, $Al_2O_3$, SiC, $Si_3N_4$, WC, Ta, $ZrO_2$, TiC, TiN, together or separately, in a matrix of hard material such as: sintered carbides or high thermal conductivity materials, such as: tungsten, molybdenum, aluminium, copper, together or separately.

Replacement of spark gaps by a transistor switch brings the following advantages:

- radical improvement of switch durability,
- repeatability of current surges,
- higher switch operation frequency (unobtainable for vacuum and air gap switches),
- lower maintenance cost (no replacements of worn-out electrodes).

An advantage of the sintering device according to the invention is the possibility of providing a unique set of sintering parameters, in particular combination of any adjusted shape and intensity within the range of 1-80 kA of the discharging current with the possibility of discharging repetition with frequency up to 100 Hz.

An advantage of the sintering device according to the invention is the possibility of turning off the transistor switch at any time (with no need of oscillatory battery discharging). This solution allows formation of rectangular pulses with duration of hundreds of microseconds and adjusted intensity already from a few kA. The possibility of current pulse forming is not achievable with the use of other known semiconductor switches or mechanical switches.

An advantage of the sintering device according to the invention is the possibility of cyclic delivering of energy to the set being sintered, either:

- in form of short pulses with the same high amplitude;

or

- delivering the same energy, but in form of cyclic oscillatory fading waveform of capacitor battery discharging i.e. underdamped waveform.

BRIEF DESCRIPTION OF THE DRAWINGS

The object of the invention is shown in embodiments in the drawings, wherein

FIG. 1*a* is a block diagram of the sintering device with a capacitor battery;

FIG. 1*b* is a block diagram of a modified device;

FIG. 2 is a plot showing the current pulse waveform in a state-of-the-art device;

FIG. 3 is a block diagram of the drive according to the invention;

FIG. 4 shows in tabular form parameters of the device according to the invention;

DETAILED DESCRIPTION

Figure 5:
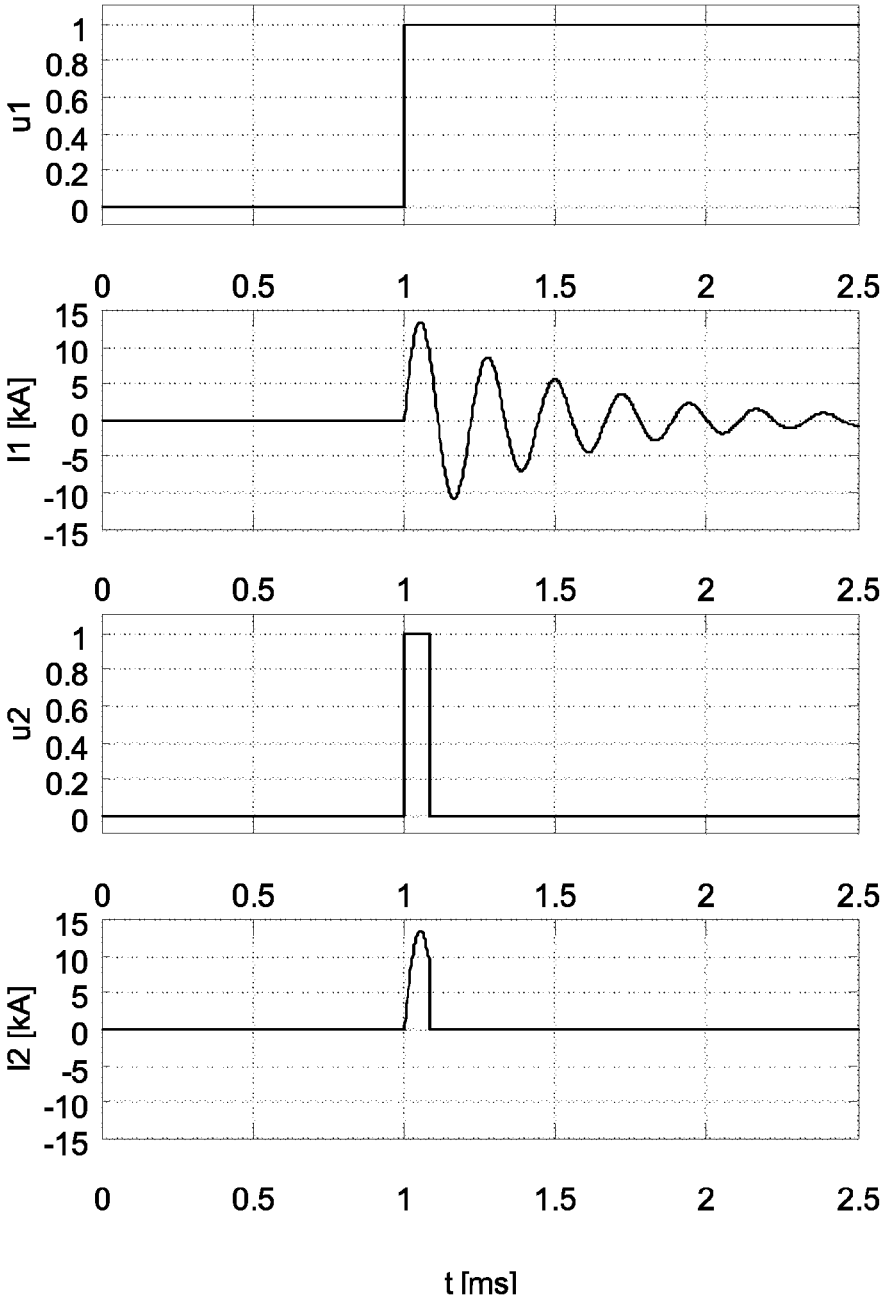
FIG. 5 is a graph showing current pulse waveform in the device according to the invention.

FIG. 3 is a block diagram of the powder sintering device. The sintering cycle is as follows: the power supply charges capacitors, which are subsequently discharged through the sintered powder placed in a graphite die between two punches connected to the capacitor battery. For controlled capacitor battery discharging a transistor switch is used. The sintering process requires a defined number of capacitor discharging cycles, with specified frequency and their charging voltage. Intensity of current flowing through the powder being sintered during discharging of capacitors achieves the value of a few to tens of kA, and its duration is of hundreds of microseconds. A very short current pulse duration with respect to separation of subsequent pulses from a fraction of a second up to a few seconds creates specific conditions of heating and cooling the sintered powder. During the current flow the powder being sintered is heated to a high temperature, and after it ceases it is cooled very quickly to defined sintering temperature. Duration of capacitor battery discharging current pulse is defined and results directly from parameters of the equivalent circuit of the system. The possibility of reduction of separation of pulses with respect to pulse duration depends on frequency at which the switch can be turned on and off.

The device according to the invention is provided with a hydraulic press 1 exerting pressure in the sintering process and in the process of cooling the sintered powder, wherein between the punches of the press the sintered powder 6 is placed. The sample 6 is between the top electrode 4 and the bottom electrode 3 inside the graphite die 9. The graphite die 9, punches 12*a*, 12*b* and the sintered powder 6 are closed in the operating chamber 2, providing a possibility of conducting the sintering process at atmospheric pressure or at lowered pressure ($1\cdot10^{-8}$ Pa), in a neutral gas or other working gas continuously supplied to the chamber. Conducting the sintering processes at atmospheric pressure allows obtaining nanocrystalline sinters with pure grain boundaries without a layer of oxides or adsorbed gasses from powders with nanocrystalline size. Conducting the sintering processes in a working gas, e.g. in hydrogen, allows obtaining a strongly reducing atmosphere.

The sintering chamber is made of low-magnetic stainless steel and is opened from one side. In the side part and in the rear part working gas inlets and connections to a vacuum system are located. Gas dosage means are not shown in the drawings. The vacuum pump system, not shown, comprises vacuum pumps adapted to operation in industrial conditions, resistant to sudden drops of high vacuum. The vacuum chamber with vacuum tightness of at least $10^{-8}$ Pa. Electrodes 3, 4 pressing the sintered powder place in the graphite die are simultaneously high-current discharge electrodes, electrically isolated from the processing chamber, and moveable vacuum passages. Electrodes 3, 4 are cooled by a cooling medium and are isolated from the chamber 2 cooled by a cooling medium. The cooling medium is typically water or transformer oil. Electrodes 3, 4 are connected to the capacitor battery 8. Cooling the electrodes 3, 4 protects the vacuum sealing against the impact of high temperature. During sintering a pressure is imposed upon the punches 12*a*, 12*b* via the electrodes 3, 4 by means of a hydraulic press 1.

The bottom electrode 3 has the possibility of travelling coarsely in order to define the initial height of the set being sintered (mechanical travel). During the sintering process a pressure is obtained by travelling of the top electrode 4 (hydraulic travel). On the electrodes there are located pads, usually made of steel, mounted by means of bolts (not shown in FIG. 3). This enables replacing them quickly. Electrodes 3, 4 are electrically isolated from the grounded operating chamber 2 by a set of ceramic-teflon sealings (not shown in FIG. 3).

The electrodes bottom 3 and top 4 are connected to the power supply system comprising: capacitive circuit 8 with capacitor battery, and transistor switch 7 closing the capacitive circuit through the sample being sintered. In parallel to the capacitor battery a high-voltage power supply unit 5 is connected.

The high-voltage power supply unit 5 provides an output of suitable current and voltage value for charging the capacitor battery. The high-voltage power supply unit 5 operates as an impulse high-voltage supply unit with current limit. The power supply unit 5 is equipped with a capacitor battery voltage measurement system, allowing their synchronous charging and discharging, and a number of protections including protection against short-circuit in internal circuit of power supply unit, a detector of temperature of inner heat sink with power components, protection against short-circuiting the power supply unit's output. A failure is signalled on a display of the device, which also serves for setting the power supply unit's operation parameters. These parameters can be set by means of a PLC program module.

The capacitive circuit 8 is a capacitor battery with equivalent capacitance within the range of 50-1000 μF, preferably equal to 250 μF, and maximal operating voltage 15 kV. It comprises low-inductance capacitors in series-parallel connection, each adapted to operation with current intensity of tens of kA and steep rise slopes of a dozen or so kA/μs.

Electric pulse discharges applied to the sample 6 are initiated by the transistor switch 7 closing the electric circuit. The transistor switch 7 is built of eight transistors connected in parallel. The transistors are arranged in a multilayer structure providing a uniform pressure of the compressive force. Transistor switches usually are not used for switching such high currents and voltages like in the capacitive circuit according to the invention. It is caused mainly by a relatively low maximal current single transistor. Thus, construction of a transistor switch adapted to operate with voltage at the level of 15 kV and currents of tens of kiloamperes requires the use of a multiple transistor series-parallel circuit and construction of a dedicated control system. In result, the transistor switch has a slightly lower efficiency than alternative solutions available on the market. However, the inventor has observed that using rectangular pulses instead of oscillatory discharging the capacitor battery a better control over the sintering process is possible, due to a more precise setting of time, duration and the energy transferred to the sintered sample by current flow. Thus, paradoxically, a solution with lower efficiency and more complicated construction has proven advantageous.

Taken into account in the construction of the transistor switch 7 are:

- selection of IGBT transistors, due to forward voltage characteristics in function of conducted current,
- mounting the transistors on a common liquid cooled heat sink (the heat sink in the form of a rectangular cuboid and the transistors mounted on both its greater sides. This construction allows serial connection of switch modules.
- each transistor has a dedicated surge suppression circuit (liquid cooled diode and resistor) and a diode "clamping" the inductance of the load,
- control signal transmitted from the control system to transistor control circuits by means of optical fibre links,
- transmit diodes of the link connected in series and controlled by one transistor,
- power supply of control circuits by means of a power converter (primary winding in the form of a HV conductor loop passing through secondary winding wound on ferrite toroidal cores,
- current leads of all transistors and diodes "clamping" the inductance of the load connected by liquid cooled Cu rails,
- between optical fibre links and control circuits of respective transistors, so-called "drivers", electronic circuits allowing individual adjustment of transistor turn-on delay and adjusted delay of its turn-off are connected. This solution protects against transistor damage during turning off the load current (the slowest transistor turns off the whole current). Delays are set so that voltage waveforms on transistors during turn-on and turn-off mutually "overlapped".

Figure 6:
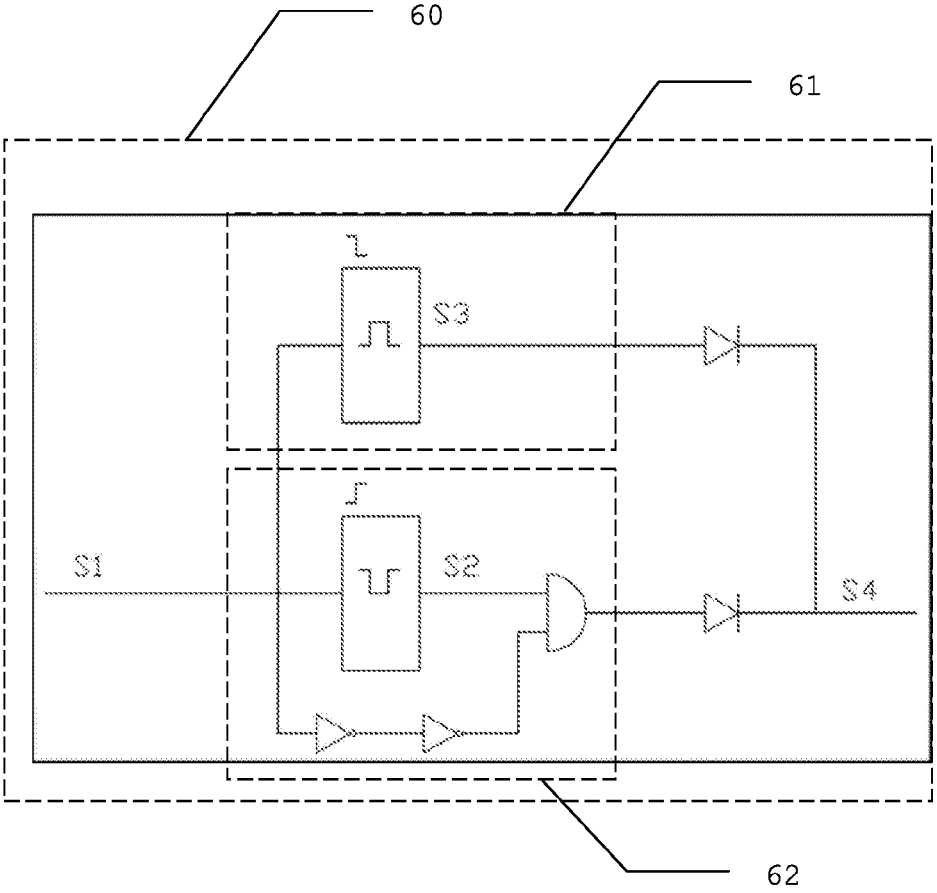
FIG. 6 is a block diagram of a circuit according to an embodiment of the invention.
Figure 7:
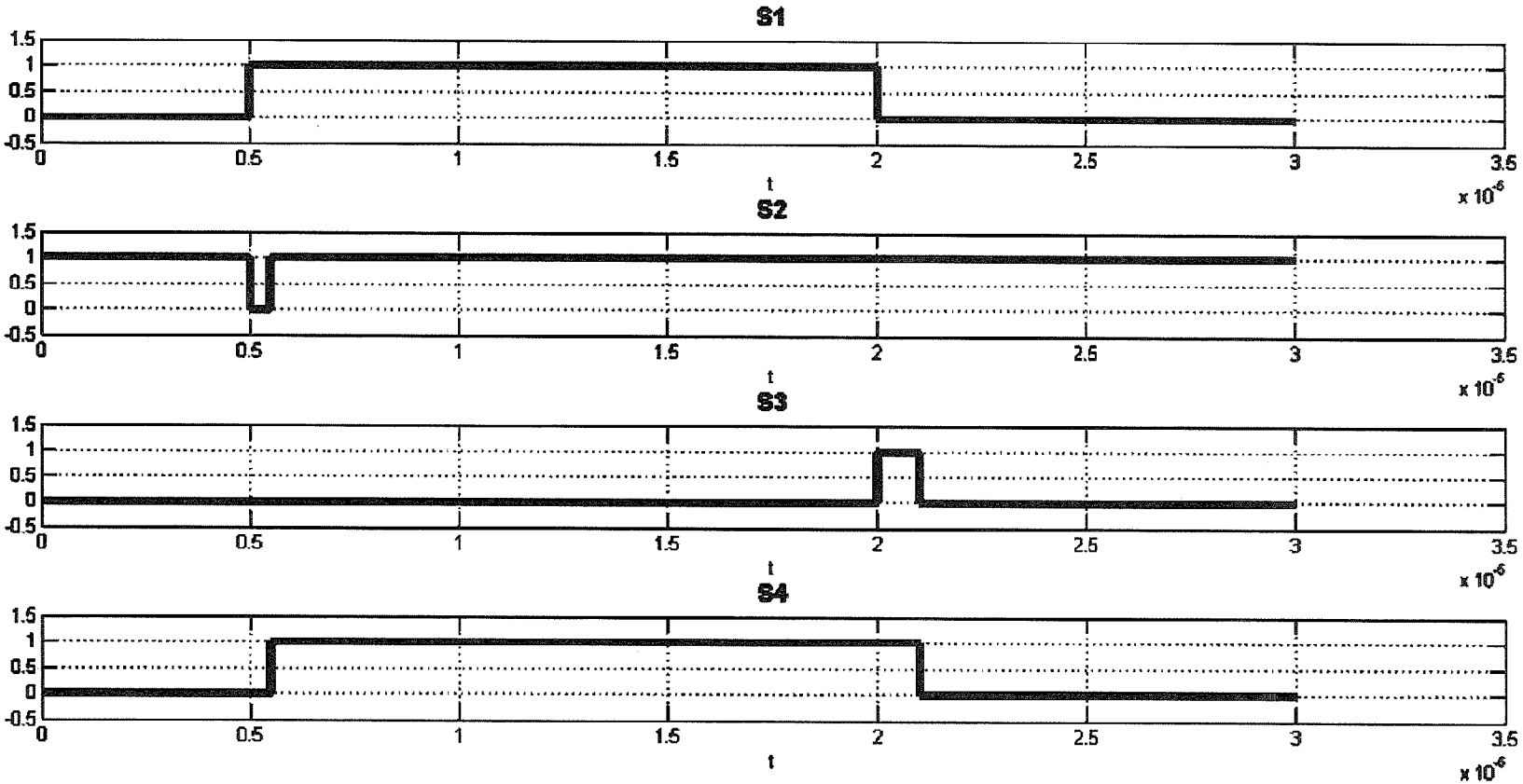
FIG. 7 illustrates exemplary waveforms of signals according to an embodiment of the invention.

A block diagram of such circuit is presented in FIG. 6. The circuit is provided with an adjusted turn-on delay path 61 and an adjusted turn-off delay path 62. The adjusted turn-on delay path 61 responds to rising edge of signal S1 common for all transistors in the switch. In response to this rising edge generates a short negative pulse in signal S2. Signals S1 and S2 are fed to an AND gate, the output of which is fed through a diode to a transistor (not shown in FIG. 6) in the form of S4 signal. The output signal of AND gate is 0 when value of signal S2 equals 0. Because signal S2 is triggered by a rising edge of signal S1, it is synchronized to its beginning. Thus connecting these signals to an AND gate results in a signal with rising edge delayed with respect to rising edge of signal S1 by the duration of the negative pulse in signal S2. The adjusted turn-off delay path comprises a circuit responsive to falling edge of the signal S1. This circuit generates in its output section S3 a positive pulse, which added through a diode to the signal from the other path causes delay of the falling edge in signal S4 with respect to falling edge in the signal S1 by duration of the positive pulse in signal S3. Such configuration provides the possibility of individual transistor turn-on and turn-off delay. This possibility is used to compensate the production spread of their time of response to control signal. Exemplary waveforms of signals S1, S2, S3, S4 are shown in FIG. 7.

Transistor switch comprising a serial connection of eight transistors rated for maximal pulse current of 5 kA can operate turning on and off current with maximal intensity of 32 kA.

Transistor switch 7 is located directly by the rack of the capacitive circuit in the form of a capacitor battery 8 to minimize lead inductance, where a significant energy is accumulated during discharging pulse rise, with rising speed achieving a few thousand amperes per microsecond.

Mounting the transistors on a common liquid cooled heat sink is preferable (heat sink in the form of rectangular cuboid and transistors mounted on both its greater sides, this construction allows serial connection of switch modules).

The sintering device according to the invention is provided with systems measuring: pressing force, pressure, temperature, size changes of electrodes/punches/consolidated power set-up (measurement of shrinkage and expansion), and monitoring current pulse waveform using a Rogowski coil and oscilloscope, and monitoring the sintering process by application of a CCD camera. Measurement of temperature is implemented in two ways: using a thermoelement 11 located directly in graphite die 9, and/or using a pyrometer 10 on the surface of the graphite die 9 in which the sintering process is conducted. All process parameters, including temperature, pressure, pressing force, current waveform and the progress of the sintering process are recorded in real time and presented in graphic form during the sintering process.

A waveform of the discharging pulse induced by closing and opening the transistor switch in the device according to the invention is shown in FIG. 5 in two embodiments. In the first one, the switch is opened and closed by the control waveform U1, shown in FIG. 5 as a binary logic waveform. The switch is open for the whole duration of the oscillatory fading capacitor battery discharging pulse. The sample is heated by current with waveform I1. In the second embodiment the switch is controlled by logic waveform U2. The capacitor battery discharging circuit is disconnected after the first positive half of discharging pulse oscillation. Then, the sintered sample is heated by current I2 with waveform close to rectangular. Also all parameters related to operating conditions of the device are continuously modified from the position of computer control panel. The parameters of the discussed sintering device are collected in the table shown in FIG. 4.

The control system of the device according to the invention comprises a central programmable logic controller (PLC)—Master, collecting data from a few secondary controllers—Slave. Secondary controllers are responsible for monitoring and control of respective subsystems: autonomous high-voltage power supply unit, vacuum system automatics. The central controller (Master) supervises operation of respective slave-type controllers:

Controller of power supply unit, providing the possibility of monitoring and real-time setting parameters of the power supply unit and is responsible for monitoring of technical condition of construction by application of a monitoring and control system for detection, localization, identification and prediction of development of damage, which can cause malfunction of the power supply unit.

Vacuum system automatics, which is managed by a distinct PLC controller. The controller is directly responsible for digital control of elements, monitoring of parameters, and also ensuring the safety.

Supervising subsystem, implemented in a distinct PLC controller. Its task is to monitor local sensors and alarming of emergency situations. The computer control panel allows to generate:

timing diagrams, for analysing data correlated in time series, event charts, for searching and presentation of data according to criteria other than time, e.g. serial number, number of used setting, tabular data, for presentation of data from any source in form of a table, provided with possibility of filtering, comments, for adding, storing and sharing explanations of process anomalies or other production events.

The method according to the invention has been presented by the way of examples of application.

For a person skilled in the art it will be apparent, that the presented embodiments of the invention and examples of application of the method according to the invention are only a possible implementation of the invention. With further development of transistor technology it will be possible to replace the system of eight transistors by a smaller number of elements rated for higher voltage and higher operating current, both in IGBT and MOSFET technology.

The invention claimed is:

1. A method of powder materials consolidation, comprising locating a sintered powder in a die between two electrodes connected to press exerting pressure thereon, applying voltage to the electrodes through a capacitive circuit with a power supply unit closed by a high-current switch, subjecting the sintered powder to simultaneous operation of pressure in the range of 1-200 MPa and consolidation by pulses of electric current with an intensity of 1-80 kA, repeated with frequency of 0.1 Hz to 100 Hz, generated by opening and closing a high-current transistor switch connected in series to the sintered powder and discharging a battery of capacitors in a capacitive circuit charged to the voltage of 0.5-15 kV with rectangular pulses of electric current.

2. The method according to claim 1, wherein the consolidation is performed in temperature in the range of 0.5 to 0.8 of the melting temperature of the consolidated material or melting temperature of the consolidated material's matrix.

3. The method according to claim 1, wherein sintered powder is selected from a group of powder materials being metallic, ceramic, intermetallic and composites comprising a metallic matrix and dispersed non-metallic particles or mixtures of thereof.

4. The method according to claim 3, wherein the powder material is selected from a group including in particular diamond, cubic boron nitride, $Al_2O_3$, SiC, $Si_3N_4$, WC, Ta, $ZrO_2$, TiC, TiN, and mixtures thereof, in a matrix of hard material selected from group including in particular sintered carbides or high thermal conductivity materials selected from a group including in particular tungsten, molybdenum, aluminium, copper, and mixtures thereof.

* * * * *